US006253801B1

(12) United States Patent
Lie

(10) Patent No.: US 6,253,801 B1
(45) Date of Patent: Jul. 3, 2001

(54) METHOD AND APPARATUS FOR DRAINING CONNECTING PIPES BETWEEN TANKS

(75) Inventor: Svein Olaf Lie, Slattum (NO)

(73) Assignee: Green Trac Holding A/S, Slattum (NO)

( * ) Notice: Subject to any disclaimer, the term of this patent is extended or adjusted under 35 U.S.C. 154(b) by 0 days.

(21) Appl. No.: 09/529,236

(22) PCT Filed: Oct. 21, 1998

(86) PCT No.: PCT/NO98/00316

§ 371 Date: Apr. 3, 2000

§ 102(e) Date: Apr. 3, 2000

(87) PCT Pub. No.: WO99/20561

PCT Pub. Date: Apr. 29, 1999

(30) Foreign Application Priority Data

Oct. 21, 1997 (NO) ..... 19974850

(51) Int. Cl.[7] ..... B65B 31/00

(52) U.S. Cl. ..... 141/50; 141/5; 141/35; 141/387; 137/571

(58) Field of Search ..... 141/5, 35, 387, 141/301, 65, 50; 137/572, 571

(56) References Cited

U.S. PATENT DOCUMENTS 3,049,226 * 8/1962 Schurr .
3,675,670 * 7/1972 Ogawa .
3,863,664 * 2/1975 Holbrook et al. ..... 141/35
3,897,807 * 8/1975 Hurst et al. ..... 141/35
4,002,192 * 1/1977 Mowatt-Larseen ..... 141/35
4,007,766 * 2/1977 Hurst .
4,008,739 * 2/1977 Hurst et al. ..... 141/35
4,266,580 * 5/1981 Dixon ..... 141/35
4,513,795 * 4/1985 Davis et al. ..... 141/35
4,711,274 * 12/1987 Mowatt-Larseen ..... 141/5
5,404,918 * 4/1995 Gustafson ..... 141/5

FOREIGN PATENT DOCUMENTS

2059892 * 4/1981 (GB) .

* cited by examiner

*Primary Examiner*—Steven O. Douglas
*Assistant Examiner*—Khoa D. Huynh
(74) *Attorney, Agent, or Firm*—Rodman & Rodman

(57) ABSTRACT

An air and gas vessel (1) having a downward opening is mounted within a tank (10, 20) for transport of liquid, e.g., oil. From the top side of the vessel runs a conduit (2) toward the inlet of the bridging hose (5) to the next tank. The conduit (2) may be closed by means of a cock (3). When the tank is filled with liquid from level A with the cock (3) closed, a volume will be stored in the vessel (1) when the tank is filled to level B. In order to drain the bridging hose (5), the cock (3) is opened. The confined air/gas volume will use up into the bridging hose (5) and the liquid volume will run back into the tank. The tanks may then be closed by means of the cocks (4) prior to starting the transport.

5 Claims, 2 Drawing Sheets

METHOD AND APPARATUS FOR DRAINING CONNECTING PIPES BETWEEN TANKS

Figure 1:
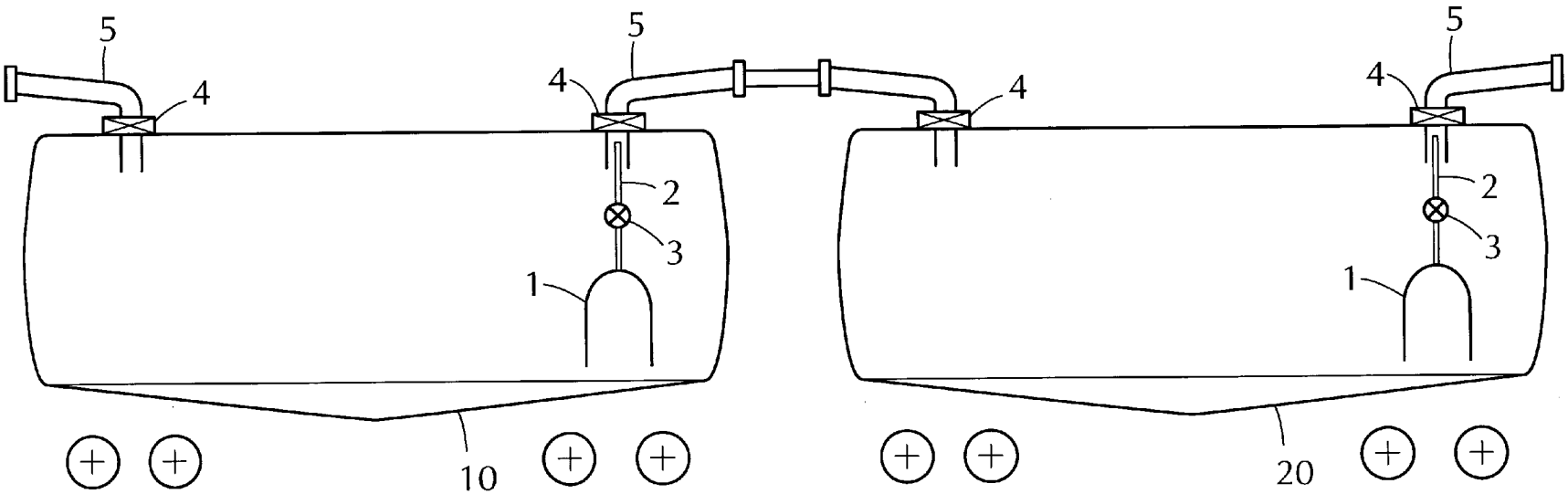

The invention relates to a method and apparatus for draining fluid that remains standing in connecting pipes, also referred to herein as bridging connections, between tanks after filling. The fluid that is filled into the tank car s is preferably oil.

In recent years there have emerged various systems for filling the tank cars in a whole tank train with the aid of permanent connecting hoses between the various tank cars. The safety regulations pertaining to the movement of these types of trains requires that each individual car shall be sealed off during transport and that the bridging connections or hose connections shall be empty of fluid during the advancement of the train. Similarly, the tanks shall not be completely filled up; rather there shall remain a safety volume of air or gas which is intended to absorb the volume changes in the fluid as a result of temperature changes Various method have been patented and practiced, among them that described in U.S. Pat. No. 4,711,274 of Dec. 8, 1987, "External Purge System for A Tank Train." This purging method requires stored volumes of extra blanket gas and compressed air for the operation and control of closure valves and an external pipe system for the entire length of the train.

With the proposed drainage system according to the invention, the external hauling of pipes and extra tanks for compressed blanket gas and control air are avoided. The air or gas volume necessary for drainage is collected and stored within the tank during the filling process. This enables the avoidance of equipment both on the tanks and at the terminal for filling and emptying. When all this equipment can be eliminated, both maintenance and operation are simplified and the system thus becomes less expensive, In addition, the air or gas volume will have a weak purge pressure corresponding to the pressure of the fluid above the container. This will ensure an efficient purging of air from the storage tank and into the bridging hose that is to be drained.

The draining of the bridging hose is made possible by shutting in a sufficiently large volume of air in an internal vessel within the main tank. This confinement of air or gas takes place during the filling of the main tank, while the liquid is rising past the lower opening of the vessel until the filing is completed. The upper part of the vessel is put into communication with the inlet to the lower portion of the bridging hose by means of a simple air conduit. The air conduit contains a cock which either closes or opens the communication between the confined air/gas volume in the vessel and the volume in the bridging hose that is to be drained.

More specifically the invention relates to an air and gas vessel for draining the bridging hoses between interconnected oil tanks, where oil has remained standing in the bridging hoses after completion of the filling process, characterized in that the vessel having a downward turned opening is positioned in the tanks, said vessel having at the upper edge thereof a pipe with a cock connected to the bridging hose between the tank cars.

Further, the invention relates to a method for draining the bridging hoses between tank cars in a tank train, consisting of a downward turned inner vessel within the tank car having a pipe and a cock connected to the bridging hose, characterized in that prior to the filling of the tanks, the vessel is empty of liquid and the cock is closed, liquid is then filled into the tanks from level (A) to level (B), with gas/air being kept confined in the vessel, the cock in the pipe is then opened to release the confined gas in the vessel up into the bridging hose in order to displace the liquid down into the tanks at the same time as the vessel is filled with liquid from the underside.

Figure 2:
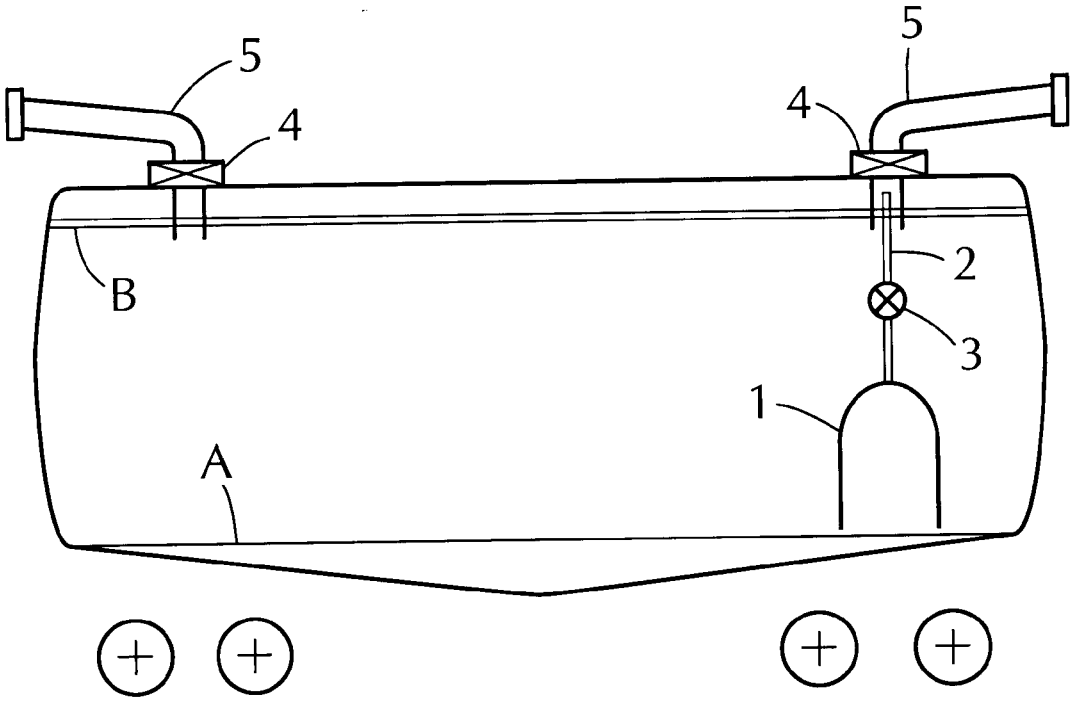

The invention will be explained in more detail with the aid of the figures, wherein the various parts of the invention are shown in FIG. 1, and the function is shown in FIG. 2.

FIG. 1 shows two tank cars 10, 20 connected by means of a bridging hose 5. The internal vessel that may be emptied and filled with air or gas is designated as 1. The internal vessel 1 has its opening facing downwards. Vessel 1 has a volume corresponding to the volume of bridging hose 5, which may be, e.g., 100–200 liters. The connection 2 between vessel 1 and bridging hose 5 between tanks 10 and 20 is merely a single pipe 2. This connection may be closed or opened by means of the cock 3. Cock 3 may be opened and closed manually or by remote control Cocks 4 at the upper edge of tank cars 10 and 20 are used to close off the cars prior to transport. For reasons of safety this bridging hose 5 must be empty of liquid during transport.

On FIG. 2 level A indicates that the tank is empty and the liquid level is below the lower opening of vessel 1. Level B indicates that tank 10 is full and that the liquid has flowed over into the next tank 20 through overflow pipe 5. When the filling is completed, the bridging hoses 5 between the tanks will be filled, and it is this volume that is to be drained back into the tanks.

When tanks 10, 20 are empty, vessel 1 will also be empty. Before the filling with liquid begins, the cocks 3 are to be closed. When the liquid level after the filling of the tank is at level B, there will be a volume of gas or air confined within vessel 1. This volume will be under a certain degree of pressure depending on the height of the liquid surface over vessel 1. To drain liquid in bridging hose 5 between the tanks, cocks 3 are opened. The confined volume of gas/air will then rise through pipe 2 and cock 3 up into the opening of bridging hose 5. The gas/air volume will press the liquid that remains standing in bridging hose 5 back down into the main tank simultaneously as vessel 1 will be filled with liquid from the underside that is open. If vessel 1 is of such a size that the volume is greater than the volume of bridging hose 5, the entire volume of bridging hose 5 will be drained down into the main tank.

What is claimed is:

1. A drainage system for draining liquid from bridging hoses between interconnected oil tanks after completion of a tank filling process wherein oil remained standing in the respective bridging hoses, wherein each of the bridging hoses have opposite ends, each end of said opposite ends communicating with a separate oil tank comprising, a) a container inside each tank, said container having an open end and an opposite closed end and being positioned inside the tank with the open end pointed in a downward direction and the closed end in an upward direction, b) a conduit in each said tank having one end connected to the closed end of each of said containers and an opposite end connected to one end of each of the bridging hoses, and c) a cock valve on each said conduit between the closed end of each said container and the one end of each of the bridging hoses, the cock valve being provided to open and close the conduit, wherein said cock valve, in an open position, allows confined air within the container to enter the one end of each of the bridging hoses through the conduit, and drain out, through the opposite end of each of the bridging hoses, the oil that has remained standing in the bridging hoses after the completion of the tank filling process.

2. The system of claim 1 wherein the cock valve is located on the conduit inside each said tank.

3. The system of claim 1 wherein a second cock valve is provided on the one end of each of said bridging hoses outside earth said tank.

4. The system of claim 1 wherein a third cock valve is provided on the opposite end of each of said bridging hoses outside each said tank.

5. A method for draining bridging hoses between interconnected oil tanks, said bridging hoses being used for filling the interconnected oil tanks, said bridging hoses having opposite ends, each end of said opposite ends communicating with a separate oil tank, said method comprising, a) position an empty container inside each of the tanks, said container having a closed upper end and an opposite open end, a conduit having one end connected to the closed upper end of the container and an opposite end connected to one end of each of the bridging hoses, a cock valve being provided on the conduit to open and close said conduit, b) close said cock valve, c) fill the tanks with liquid from level A to level B with air being kept confined in the container, d) open the cock valve in the conduit to release the confined air in the container up into the one end of each of the bridging hoses in order to displace the remained standing liquid in the bridging hoses down into the successive tank at the same time as the container is filled with liquid from the open end.

* * * * *

UNITED STATES PATENT AND TRADEMARK OFFICE

CERTIFICATE OF CORRECTION

PATENT NO. : 6,253,801 B1
DATED : July 3, 2001
INVENTOR(S) : Svein Olaf Lie

It is certified that error appears in the above-identified patent and that said Letters Patent is hereby corrected as shown below:

Title page,
ABSTRACT, line 10, change "use" to -- rise --.

Column 1,
Line 7, change "car s" to -- cars --.
Line 45, change "filing" to -- filling --.

Column 3,
Line 7, change "earth" to -- each --.

Signed and Sealed this

Thirtieth Day of April, 2002

*Attest:*

*Attesting Officer*

JAMES E. ROGAN
*Director of the United States Patent and Trademark Office*